United States Patent [19]

Borel

[11] Patent Number: 4,499,927

[45] Date of Patent: Feb. 19, 1985

[54] TWO-PLY SCREEN FOR THE SHEET FORMING ZONE OF A PAPERMAKING MACHINE

[75] Inventor: Georg Borel, Reutlingen, Fed. Rep. of Germany

[73] Assignee: Hermann Wangner GmbH & Co KG, Fed. Rep. of Germany

[21] Appl. No.: 559,015

[22] Filed: Dec. 8, 1983

Related U.S. Application Data

[63] Continuation of Ser. No. 303,331, Sep. 18, 1981, abandoned.

[30] Foreign Application Priority Data

Sep. 26, 1980 [DE] Fed. Rep. of Germany ..... 3036409

[51] Int. Cl.[3] ..... D03D 15/00; D03D 15/02; B21F 1/10; B10D 39/08

[52] U.S. Cl. ..... 139/425 A; 139/383 A; 139/413; 162/DIG. 1; 162/348

[58] Field of Search ..... 139/383 A, 383 AA, 383 R, 139/425 A, 425 R, 408–413; 162/DIG. 1, 348, 162/349, 358; 245/8

[56] References Cited

U.S. PATENT DOCUMENTS

| | | | |
|---|---|---|---|
| 3,885,603 | 5/1975 | Slaughter | 139/425 A |
| 4,041,989 | 8/1977 | Johannsson et al. | 139/425 A |
| 4,071,009 | 10/1979 | Karm | 139/425 A |
| 4,071,050 | 1/1978 | Codorniu | 139/425 A |
| 4,112,982 | 9/1978 | Bugge et al. | 139/425 A |
| 4,289,173 | 9/1981 | Miller | 139/383 A |
| 4,314,589 | 2/1982 | Buchanan et al. | 139/425 A |
| 4,344,464 | 8/1982 | Thompson et al. | 139/425 A |
| 4,359,069 | 11/1982 | Hahn | 139/425 A |

FOREIGN PATENT DOCUMENTS

| | | | |
|---|---|---|---|
| 40-15842 | 7/1965 | Japan | 139/383 A |

*Primary Examiner*—James Kee Chi

*Attorney, Agent, or Firm*—Sughrue, Mion, Zinn, Macpeak & Seas

[57] ABSTRACT

A two-ply screen for the sheet forming zone of a papermaking machine comprises weft filaments arranged in pairs one over the other and warp filaments with all the warp filaments being woven into the top layer of the screen. Only part of the warp filaments are woven also into the bottom layer of the screen. The number of warp filaments in the top fabric layer serving to form the paper sheet is twice that contained in the bottom layer. The lower weft filaments are at least 20% and preferably at least 30% thicker than the warp filaments.

2 Claims, 10 Drawing Figures

TWO-PLY SCREEN FOR THE SHEET FORMING ZONE OF A PAPERMAKING MACHINE

This application is a continuation, of application Ser. No. 303,331, filed 9/18/81, now abandoned.

BACKGROUND OF THE INVENTION

The present invention relates to a two-ply screen (fabric) for the sheet forming zone of a papermaking machine consisting of weft filaments arranged in pairs one over the other and of warp filaments, all the warp filaments being woven into the top layer of the screen.

Such screens have been known from German OS No. 2,263,476 and OS No. 2,540,490. In these screens all the warp filaments on the backing side pass below the weft filaments to that they are exposed to abrasion. Two-ply screens break immediately when the warp filaments are worn through since the warp filaments transmit all the driving force exerted on the screen. Thus, wear of the warp filaments is the normal cause of screen failure. This primarily applies to the screens described in German OS No. 2,263,476 in which the warp filaments are worn through long before the weft filaments are consumed on the backing. German OS No. 2,540,490 proposes to overcome this difficulty and partially solves this problem in that on the backing the warp filaments pass under only one weft filament. Consequently the warp bends on the backing are substantially shorter and the weft bends are longer. Therefore, the crimp of the weft filaments can be enlarged so that the warp filaments on the backing are quasi embedded in the weft filaments. By means of sufficient setting one can make sure that the weft filaments are worn through before the warp filaments are. However, it is a disadvantage that the weft filaments may be only a few hundredths of a millimeter thicker than the warp filaments because otherwise the warp filaments are urged downwardly and outwardly by the thicker and stiffer weft filaments and thus more exposed to wear. Therefor, in such a screen it is not possible to use thicker weft filaments to provide more volume for abrasion.

Numerous attempts have been made to prolong the service life of multi-ply papermachine screens. For example, German OS No. 2,455,185 teaches assembling a papermachine screen from two separate fabric webs interconnected by a special binder warp. The binder warp, however, extends partially on the backing beneath the weft filaments so that it is exposed to wear. The thinner the binder warp the sooner will it be worn through. Such a screen composed of two separate fabric webs is very expensive and complicated. Also, European patent application No. 0 010 311 teaches the use of a highly reduced number of weft filaments on the backing of a two-ply papermachine screen to make the screen more permeable. In order to prolong the service life a number of warp filaments are woven only into the lower layer of the screen to thereby increase the volume available for abrasion. These warp filaments in the bottom layer also determine the spacing of the warp filaments in the top layer. The small number of warp filaments on the papermaking side results in substantial screen marks in the paper. It is a special disadvantage of this screen that there is a small number of weft filaments and a large number of warp filaments on the backing side. Both features have the consequence that in each repeat three or four warp filaments wrap around each weft filament so that the latter have no free length to bend outwardly toward the backing side. This screen is thus a typical warp runner and breaks after a relatively short time, namely as soon as the exposed bends of the warp filaments are worn through. Although FIG. 5A of the European patent application shows a screen in which a number of warp filaments do not bend downwardly, i.e. they are not woven into the bottom layer, the filament ratio on the backing is nevertheless unfavorable because more warp filaments than on the papermaking side are woven into the few weft filaments on the backing side.

SUMMARY OF THE INVENTION

The present invention has the object of providing a two-ply screen contemplated for the sheet forming zone of a papermaking machine which has a prolonged service life while leaving only slight screen marks in the paper and possessing high stability in machine and transverse direction. With a screen of the initially defined type this object is realized in that only a part of the warp filaments are woven into the bottom layer of the screen.

In another embodiment of the invention the lower weft filaments are at least 20% and preferably at least 30% thicker than the warp filaments whereby the service life is additionally prolonged by the larger abrasion volume of the lower weft filaments.

The screen of the present invention can be most simply produced when the number of warp filaments on the papermaking side is twice as high as on the backing since then every second warp filament is not woven into the bottom layer. However, it is also possible to weave only every third, fourth, etc. warp filament into the bottom layer so that the ratio of warp filaments in the top and bottom layers is 3:1, 4:1 etc. The number of warp filaments in the top layer on which the paper sheet is formed is preferably at least twice as high as in the bottom layer. The small number of warp filaments in the bottom layer results in a so called weft runner fabric and very long weft floats, i.e. long free sections of the weft filaments, so that the wear is distributed over a large volume of filaments.

Compared with a two-ply or multi-ply screen composed of a plurality of separate fabric webs, such as disclosed in German OS No. 2,455,185, the screen of the present invention offers all the advantages of a two-ply screen. In particular, the fact that the screen is not assembled from separate fabric webs substantially reduces the tendency of clogging with soil and significantly simplifies the entire course of production of the screens. Weaving requires a lesser number of warping drums and after completion of a screen the equipment can be adapted to any desired conventional weave without any change in the harness system. Also seaming of flat-woven screens is accomplished with conventional equipment and is far simpler than with screens composed of a plurality of separate fabric layers in which each individual layer must be separately seamed.

The length of the weft floats on the backing can be shortened upon requirement without variation of the screen structure on the paper forming side by passing the warp filaments woven into the bottom layer around the lower weft not only once per repeat but two or more times or passing them under two wefts of the bottom layer. Thus, for example, the free weft floats can be reduced from 9 to 7 warp filaments without sacrificing or impairing the advantages of this novel type of weave, because at least half of the warp filaments remain buried in the screen interior and intact till the end of the service life because they are not subject to wear.

The warp filaments and the weft filaments are generally made up of synthetic monofilaments. Polyester and polyamide monofilaments are especially suitable. Moreover, the screens are generally woven in flat form in view of the difficulty to round-weave two-ply screens.

It is a further advantage of the screen of the present invention that due to the higher number of warp filaments in the top layer the paper forming screen face has a finer structure leaving weaker markings in the paper.

The warp filaments woven only into the top layer of the screen will hereinafter be designated as "force transmitting warp" as they take up the major portion of the longitudinal tension exerted on the screen. As the force transmitting warp extends largely straight through the screen, the screen of the invention has a minor constructional elongation. The warp filaments woven into both layers are hereinafter referred to as "construction warp". The force transmitting warp may be thinner than the construction warp, or it may be made of less elongatable material than the construction warp. In particular, for the construction warp a more elastic material may be employed than is normally used for warp filaments in a papermachine screen.

DETAILED DESCRIPTION OF THE INVENTION

Figure 1:
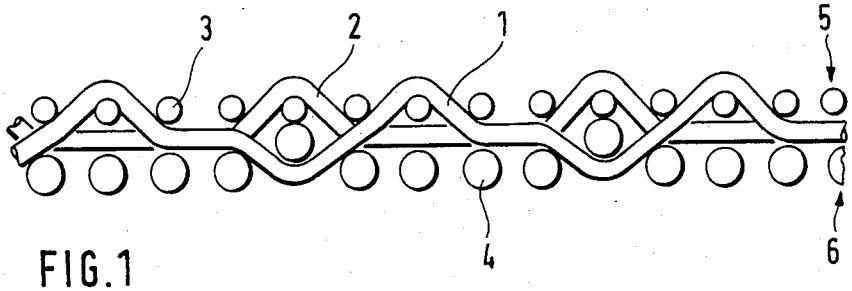
FIG. 1 is a longitudinal sectional view through a papermachine screen with a construction warp illustrated in front of a force transmitting warp.
Figure 2:
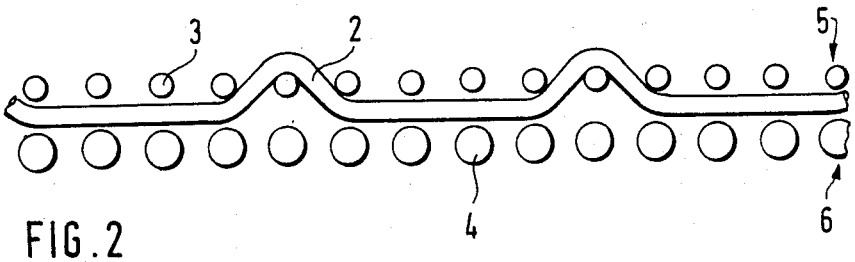
FIG. 2 is a view similar to FIG. 1 illustrating the course of the force transmitting warp in detail.
Figure 3:
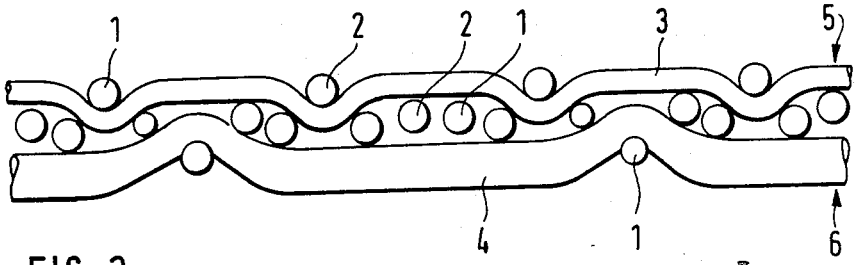
FIG. 3 is a sectional view taken transversely through the screen.

The screen illustrated in FIGS. 1 to 3 is woven flat, i.e. the warp filaments extend in the machine direction and the weft filaments extend transversely to the machine direction. The screen contains two layers of weft filaments, namely the upper weft filaments 3 forming the paper forming side of the screen, and the lower weft filaments 4 forming the backing of the screen. Each upper weft filaments 3 is arranged above a lower weft filament 4, i.e. the weft filaments are provided in pairs. The screen contains at least two types of warp filaments, namely a so-called construction warp 1 woven into the top layer 5 and into the lower layer 6, and a so-called force transmitting warp 2 woven only into the upper layer 5.

The screen of the present invention can be made in any type of weave, i.e. satin weave, twill or a modification thereof. Preferably the screen has a satin weave, i.e. the binding points do not touch and are uniformly distributed. On the paper forming side of the screen the number of warp filaments is substantially greater than on the backing side since a number of the warp filaments, namely the force transmitting warp 2, are not woven into the bottom layer. The force transmitting warp 2 is therefore not worn down in operation and is not subject to abrasion. None of the warp filaments are woven only into the bottom layer 6. All the warp filaments, i.e. both the construction warp 1 and the force transmitting warp 2, are woven into the top layer 5. This force transmitting warp 2 can take up the screen tension even when the warp and weft filaments on the backing side (bottom layer 6) of the screen are completely worn down. This demonstrates the decisive advantage of this form of screen. The screen has a filament system protected against abrasion which holds the fabric together long after the filaments provided for wear are consumed. The force transmitting warp 2 should extend in the interior of the screen as far as possible to give a screen that leaves but slight markings and permits good discharge of the sheet. Moreover, the force transmitting warp 2 should have only few crimps, i.e. it should follow a straight course in order to impart to the screen high longitudinal stability and low constructional elongation.

Figure 4:
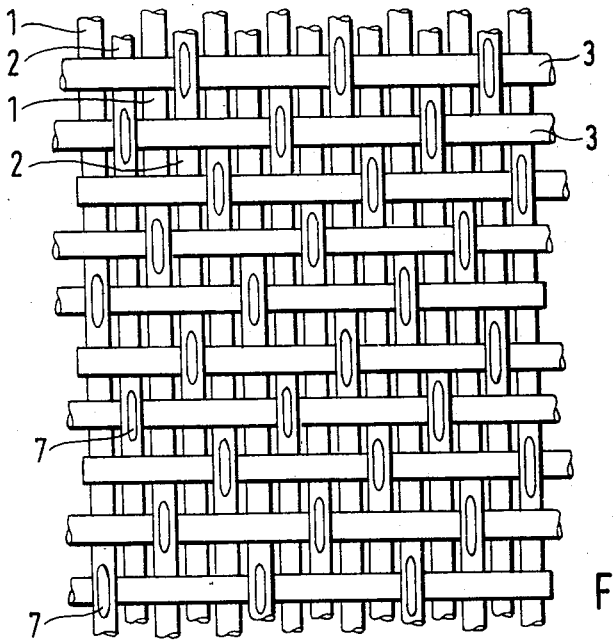
FIG. 4 is a plan view showing the weave of the paper forming side of a 10-harness woven fabric.
Figure 5:
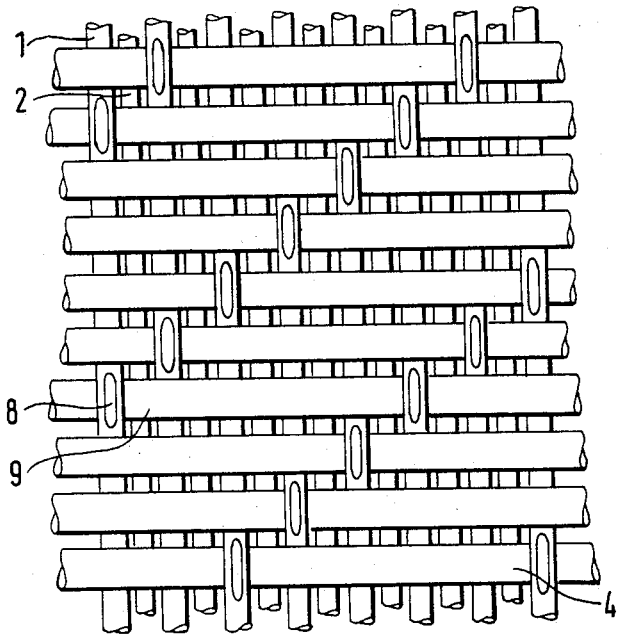
FIG. 5 is a plan view showing the weave of the back side of the fabric of FIG. 4.

FIGS. 4 and 5 show the weave on the paper forming side and on the backing side of a screen, according to the present invention. The plan view of FIG. 4 shows a 5-harness satin weave and that of FIG. 5 a 10-harness satin weave. In FIG. 4 the binding points 7 correspond to the crimps in the construction warp 1 and the force transmitting warp 2, while in FIG. 5 the binding points 8 are formed only by the construction warp 1.

Figure 6:
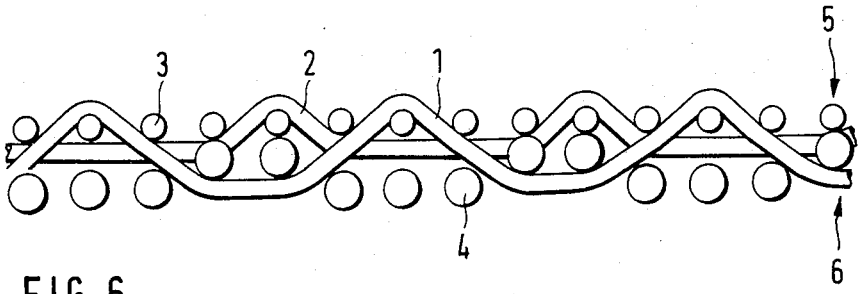
FIG. 6 is a view similar to FIG. 1 of a modified weave of the papermachine screen in which the construction warp passes underneath two weft filaments of the bottom layer.
Figure 7:
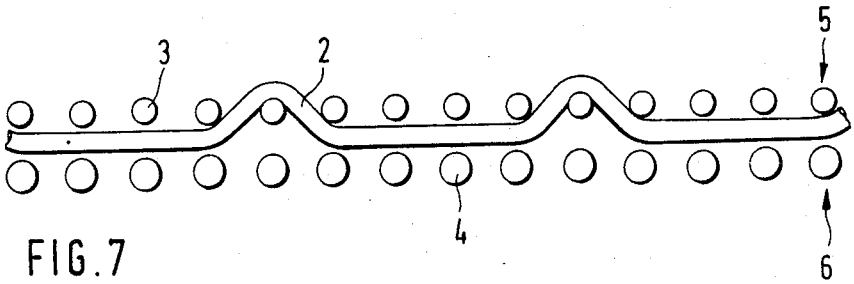
FIG. 7 is a view showing the course of the force transmitting warp in the papermachine screen of FIG. 6.
Figure 8:
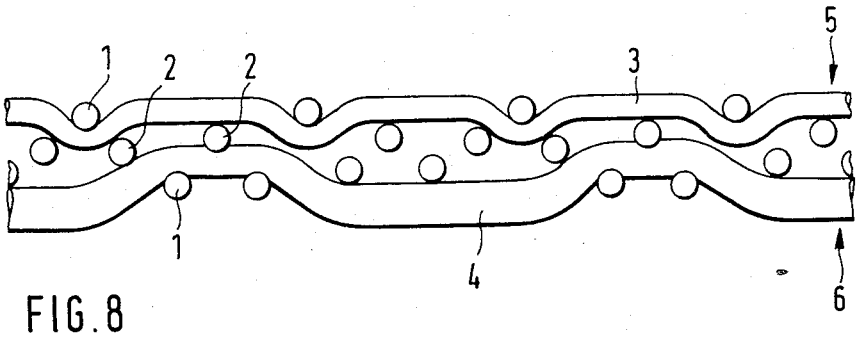
FIG. 8 is a transverse sectional view through the modified embodiment of the screen weave.

FIGS. 6 to 10 show a modified embodiment of the present invention. The construction warp 1 extends on the backing under two weft filaments (FIG. 6). The force transmitting warp 2 extends predominantly in the interior of the screen engaging merely the weft filaments 3 and the top layer 5. The necessary tensile strength of the fabric remains intact after the destruction of the bottom layer of the screen. The course of the force transmitting warp 2 is the same in both weaves so that FIGS. 2 and 7 are identical.

Figure 9:
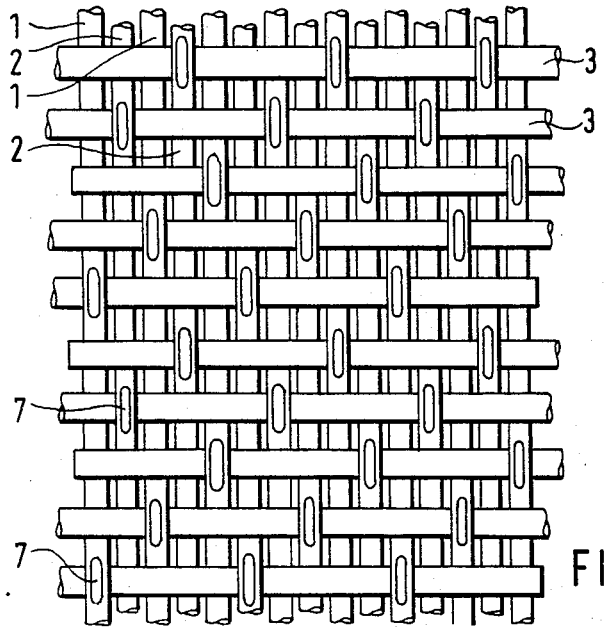
FIG. 9 is a plan view of the paper forming side in a modified weave.
Figure 10:
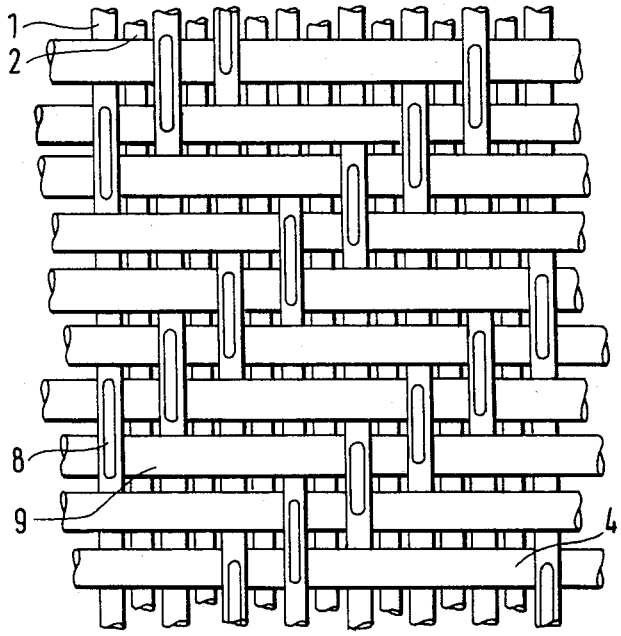
FIG. 10 is a plan view of the backing of the fabric of FIG. 9.

The structure of the top layer of both screen embodiments is also identical so that the appearance of the weave is the same in FIGS. 4 and 9. Only the bottom screen layer (FIG. 10) shows longer warp crimps 8 and shorter crimps 9 of the weft filaments. In the crimps 8 on the backing side the two warp filaments 1 are always disposed in pairs thereby doubling the crimping effect of said warp filaments.

In the examples for this embodiment of the invention a 10-harness satin weave fabric is shown. The control of the length of the weft floats in the bottom layer is significant primarily in fabrics with a higher pattern repeat so that on the backing side the length of the weft bend can be adapted to the requirements of each individual case.

EXAMPLE

In a 14-harness satin weave fabric with a density of 52 polyester monofilament warp filaments per centimeter and a filament diameter of 0.20 mm the top fabric layer 5 has an appearance corresponding to a 7-harness repeat length. The number of weft filaments in both layers is 24 per centimeter. The diameter of the weft filaments 3 of the top layer is 0.18 mm and the weft filaments all consist of polyester monofilaments. The bottom fabric layer 6 is woven from substantially thicker weft filaments, namely from 0.27 mm diameter polyester monofilaments. In order to further increase the abrasion resistance it is possible to weave into this layer alternatingly polyester and polyamide monofilaments. Depending on the stress to which the screen is subjected during use the sequence may be 1:1 and in extreme cases it may be 2:1. In that case, two polyamide filaments and one polyester filament are used.

What is claimed is:

1. A two-ply fabric for the sheet forming zone of a papermaking machine comprising a plurality of weft filaments arranged in pairs one over the other and a plurality of warp filaments wherein all of said warp filaments are woven into the top ply to reduce marking and increase retention, a first portion of the warp filaments are woven into the top ply as well as into the bottom ply of said fabric and a second portion of the warp filaments are woven only into the top ply of said fabric with the number of warp filaments in the top ply being at least twice that contained in the bottom ply.

2. A two-ply fabric as set forth in claim 1, wherein the lower weft filaments are at least thirty-percent thicker than the warp filaments.

* * * * *